United States Patent [19]

Muschner

[11] Patent Number: 4,702,460

[45] Date of Patent: Oct. 27, 1987

[54] REVERSIBLE REFRACTORY PLATE IN SLIDING CLOSURE UNIT AND METHOD FOR USE THEREOF

[75] Inventor: Udo Muschner, Tönisvorst, Fed. Rep. of Germany

[73] Assignee: Didier-Werke AG, Wiesbaden, Fed. Rep. of Germany

[21] Appl. No.: 893,447

[22] Filed: Aug. 7, 1986

Related U.S. Application Data

[63] Continuation of Ser. No. 678,033, Dec. 4, 1984, abandoned.

[30] Foreign Application Priority Data

Dec. 16, 1983 [DE] Fed. Rep. of Germany ..... 3345539

[51] Int. Cl.[4] ..... B22D 41/08

[52] U.S. Cl. ..... 266/45; 266/287; 222/600; 222/590

[58] Field of Search ..... 266/44, 236, 287, 271, 266/275, 272; 222/590, 591, 600, 601, 598, 597

[56] References Cited

U.S. PATENT DOCUMENTS

| | | | |
|---|---|---|---|
| 3,684,267 | 8/1972 | Andrzejak et al. | 222/600 |
| 3,866,806 | 2/1975 | Shapland, Jr. | 222/600 |
| 4,141,478 | 2/1979 | Meier | 222/600 |
| 4,314,659 | 2/1982 | Shapland | 266/236 |
| 4,376,501 | 3/1983 | Hafner et al. | 222/600 |
| 4,601,416 | 7/1986 | Schittknecht et al. | 222/600 |

FOREIGN PATENT DOCUMENTS

| | | | |
|---|---|---|---|
| 2459568 | 1/1976 | Fed. Rep. of Germany | 222/600 |
| 2850183 | 5/1979 | Fed. Rep. of Germany . | |
| 3243305 | 5/1984 | Fed. Rep. of Germany . | |
| 2411542 | 8/1979 | France | 222/600 |
| 1349591 | 4/1974 | United Kingdom . | |
| 1494477 | 12/1977 | United Kingdom . | |

OTHER PUBLICATIONS

Russian Language Document "Modern Methods in the Operation of Cupola Furnaces", 12/1960, pp. 28–31, by A. A. Ananjin.

"On Further Developments of Basic Ceramic Components in Sliding-Gate System", Wilfried Deilmann et al, 1979, pp. 1156–1168.

*Primary Examiner*—John P. Sheehan
*Assistant Examiner*—S. Kastler
*Attorney, Agent, or Firm*—Wenderoth, Lind & Ponack

[57] ABSTRACT

A refractory plate used as a stationary and/or as a movable closure plate in a sliding closure unit for discharging molten metal from a metallurgical vessel includes a refractory plate body having parallel opposite planar surfaces. A first discharge opening extends through the body between the parallel surfaces and is used for initial operation. At least one other discharge opening extends through the body between the parallel surfaces and is sealingly closed by a stopper plug of refractory material. Upon erosion damage to the first discharge opening, such damaged opening may be closed by a stopper plug of refractory material, the stopper plug may be removed from the other discharge opening, and the plate may be reversed such that the other discharge opening then is employed for further operation of the plate.

20 Claims, 4 Drawing Figures

REVERSIBLE REFRACTORY PLATE IN SLIDING CLOSURE UNIT AND METHOD FOR USE THEREOF

This application is a continuation of now abandoned application Ser. No. 678,033, filed Dec. 4, 1984.

BACKGROUND OF THE INVENTION

The present invention relates to a refractory plate for use as a stationary and/or as a movable closure plate in a sliding closure unit, either of the linear movable or rotary movable type, for controlling the discharge of molten metal from a metallurgical vessel. The present invention further relates to a sliding closure unit employing such refractory plate or plates. The invention even further relates to a method of use of such plate or plates for increasing the useful life thereof in the operation of such a sliding closure unit.

Refractory plates are known for use as a stationary closure plate fixed in relation to a metallurgical vessel and as a movable closure plate in sliding contact with the stationary closure plate and slidable with respect thereto. The stationary and movable plates each have therethrough at least one discharge opening. The movable plate is slidable with respect to the stationary plate between an open position with the discharge openings in alignment, thereby discharging melten melt from the vessel, and a closed position with the discharge opening of each plate being blocked by an abutting sliding surface of the other plate, thereby interrupting discharge of the molten metal. Thus, in the closed position of the unit, the discharge opening in the stationary plate is covered by the respective sliding surface of the movable plate, i.e. the so-called working surface thereof on which rests the molten metal. During use of the unit, the abutting sliding surfaces of the two plates in the areas of the discharge openings thereof become damaged due to corrosion and erosion by the molten metal. This causes the discharge openings to be enlarged to an undesirable degree during continued use of the unit. As a result, the unit does not provide the necessary tightness and sealing, and the stationary and movable plates can be used for only a few discharge operations, after which they must be discarded.

Since the closure plates are formed primarily of high quality ceramic refractory material, attempts have been made in the past to prolong the useful life of the closure plates by rotating them or by turning them over so that opposite surfaces of the plates are placed in sliding abutting contact. However, this employs the same discharge openings which already are erosion damaged and thereby considerably weakened. The use of the plates in this reversed position therefore is significantly less than the first use of the plates before reversal. With regard to rotary sliding closure units, it has been attempted to rotate the plates to put into use entirely new discharge openings. However, this solution requires that plural discharge openings in the plates be spaced by a considerable distance to ensure the necessary working surfaces between adjacent openings. This has resulted in arrangements of rotary units having plates with only two or three discharge openings without unduly increasing the size of the units.

SUMMARY OF THE INVENTION

With the above discussion in mind, it is an object of the present invention to provide an improved refractory plate for use as a stationary and/or as a movable closure plate in a sliding closure unit of either the linear movable type or the rotary movable type for controlling the discharge of molten metal from a metallurgical vessel, whereby the above and other prior art disadvantages are overcome.

It is a further object of the present invention to provide such a refractory plate having an increased useful life without having an unduly increased size.

It is a still further object of the present invention to provide an improved sliding closure unit incorporating such refractory plate as the movable closure plate and/or the stationary closure plate thereof.

It is a yet further object of the present invention to provide an improved method of use of such plate whereby it is possible to increase the useful life thereof.

These objects are achieved in accordance with the present invention by the provision that the refractory plate includes a refractory plate body having parallel opposite planar surfaces, a first discharge opening extending through the body between the parallel surfaces, at least one other discharge opening extending through the body between the parallel surfaces, and a stopper plug of refractory material sealingly closing the other discharge opening.

Preferably, the body and the plug are formed of identical refractory materials, and in one arrangement of the present invention the plug may comprise a drill core resulting from the core drill formation of one of the discharge openings. The discharge openings may have the same or different dimensions. The plug may be fixed in the other discharge opening by means of a ceramic setable mortar. When employed in a linear sliding closure unit, the other discharge opening in the plate opens onto that parallel surface adapted to be in abutting sliding contact with a surface of the other plate of the unit, at an area of that surface adapted to cover a discharge opening of the other plate upon closing of the unit. The plug is flush with that surface. Thus, the second discharge opening does not in any way impair the operation of the movable plate upon movement thereof to the closed position.

Upon use of the unit, erosion damage inevitably occurs to the surface of the plate in abutting sliding contact with the other plate, at the area around the operable discharge opening thereof. The plate may be reversed with the opposite surface then in sliding contact with the other plate and with the erosiondamaged surface spaced therefrom. The plug is removed from the other discharge opening, and a stopper plug of refractory material sealingly closes the erosion-damaged original discharge opening. The plate then is operable again for an entirely new sequence of discharging operations, the effective life of which is equal to that of the first arrangement of the plate.

The present invention equally may be applied to one or the other of the stationary and movable closure plates, or may be applied to both closure plates, particularly if the two plates have the same dimensions and are interchangeable. However, it is possible in accordance with the present invention to design only one of the closure plates in accordance with the novel features of the invention.

In further accordance with the present invention, the other discharge opening may be formed after the plate has been used once, for example by a drilling operation.

Preferably, the refractory materials of the plate body and of the stopper plug are identical. This prevents different abrasions in different areas of the surface of the plate which is in sliding abutting contact with the other plate. This also prevents the occurrence of thermal stresses.

In a particularly economical arrangement of the present invention, the stopper plug comprises a drill core resulting from core drill formation of one of the discharge ports itself. When the discharge openings in the plate have the same dimensions, the same plug can be used in each such discharge opening. When the plug is fixed in respective discharge openings by means of a ceramic setable mortar, the plug easily can be removed when necessary.

When the refractory plate is employed in a linear sliding closure unit, the plate is provided with two discharge openings, the second of which is located at an area and spacing from the first opening to provide a relatively compact design without impairing operation. When the concept of the present invention is employed with a rotary sliding closure unit, plural discharge openings may be spaced circumferentially of the plate at relatively close spacings. However, it further is possible in accordance with the present invention to provide several pairs of discharge openings having the same cross section. For example, one pair of openings may have a relatively narrow discharge dimension, and another pair of openings may have a relatively large discharge dimension. At first, one of the discharge openings of the two pairs is open and the second discharge opening of the two pairs is closed with a stopper plug. After reversal of the plate, the second discharge openings are opened and the first discharge openings are closed with plugs.

Other combinations and modifications of structural arrangements as will be apparent to those skilled in the art are employable for refractory plates employable in both linear and rotary sliding closure units.

BRIEF DESCRIPTION OF THE DRAWINGS

Other objects, features and advantages of the invention will be apparent from the following detailed description of a preferred embodiment thereof, with reference to the accompanying drawings, wherein.

DETAILED DESCRIPTION OF THE INVENTION

Figure 2A:
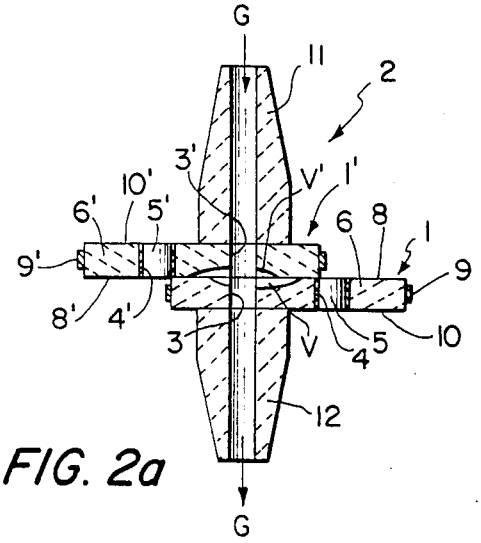
FIG. 2*a* is a somewhat schematic vertical cross section through a sliding closure unit incorporating the plate of FIG. 1*a* and illustrating the erosion damage thereto.

FIG. 2*a* illustrates portions of a linear sliding closure unit including an inlet sleeve 11, a stationary refractory plate 1' according to the present invention and fixedly positioned with respect to a metallurgical vessel (now shown), a movable refractory plate 1 according to the present invention and mounted for sliding movement relative to stationary plate 1', and an outlet sleeve 12. Each plate 1, 1' comprises a respective refractory plate body 6, 6' having parallel opposite entirely planar surfaces 8 and 10, 8' and 10'. Further, each plate 1, 1' has extending through the respective body thereof between the parallel surfaces thereof respective discharge openings 3, 3'. Further, each plate 1, 1' has a respective exterior reinforcement structure, such as a conventional metal shrunk-fit ring 9, 9' to ensure that the refractory material of each plate stays bound together, even if the plate cracks during service. The plates initially are assembled with mutual planar surfaces 8, 8' in abutting sliding contact, wherein movable plate 1 is slidable with respect to stationary plate 1' between an open position (shown in the drawings) with discharge openings 3, 3' in alignment and a closed position (not shown, but with plate 1 moved to the left as shown in the drawings) with the surfaces 8, 8' respectively blocking discharge openings 3', 3.

Figure 1A:
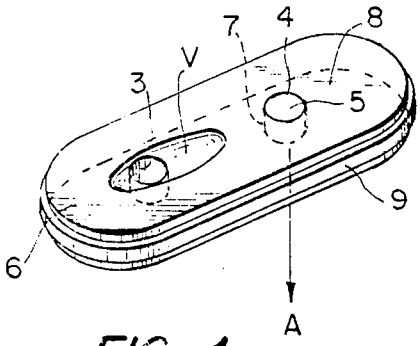
FIG. 1*a* is a somewhat schematic perspective view of a movable closure plate according to the present invention, after initial use thereof and illustrating erosion damage thereto.

Upon use of the unit to achieve discharge of molten metal, erosion damage occurs to the surfaces 8, 8' at the areas thereof around discharge openings 3, 3'. This erosion damage is indicated in FIG. 2*a* at V, V'. Furthermore, this damage to surface 8 of movable plate 1 is shown more clearly in FIG. 1*a*.

To prolong the useful life of plates 1, 1', the plates are provided in accordance with the present invention with additional discharge openings 4, 4', and these other openings initially are sealingly closed by respective stopper plugs 5, 5' of refractory material. Preferably, the bodies 6, 6' and plugs 5, 5' are formed of identical refractory materials. This particularly may be achieved by forming the plugs 5, 5' as drill cores resulting from core drill formation of at least one of the respective discharge openings. As illustrated, plugs 5, 5' each have a uniform shape throughout the length thereof in a direction axially of openings 4, 4'. The discharge openings in each plate may have the same dimensions. Further, the plugs may be fixed in the respective other discharge openings by means of a ceramic setting mortar, shown at 7 in FIG. 1*a*.

When the sliding closure unit is a linear sliding closure unit as shown in the drawings, other discharge opening 4 opens onto surface 8 at an area thereof adapted to cover discharge opening 3' of plate 1' upon movement of plate 1 from the open position thereof. Plug 5 thus is flush with surface 8 and does not in any way interfere with the normal operation of the unit.

Figure 1B:
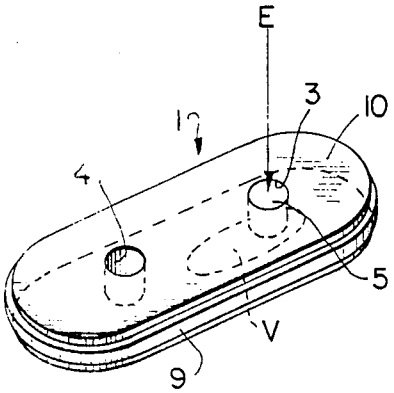
FIG. 1*b* is a view similar to FIG. 1*a*, but showing the refractory plate thereof inverted and in the condition before further use thereof in the reversed condition.
Figure 2B:
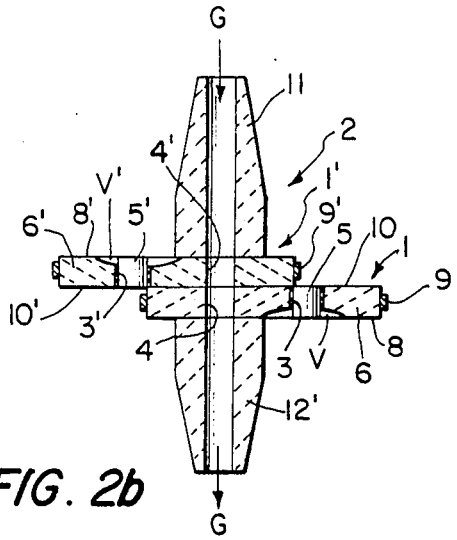
FIG. 2*b* is a view similar to FIG. 2*a* but illustrating the plate in the orientation shown in FIG. 1*b*, and also illustrating the stationary closure plate reversed in accordance with the present invention.

When the extent of erosion damage V, V' has become so great that reliable operation of the unit no longer is possible, then one or both of the plates may be reversed in the manner shown in FIGS. 1*b* and 2*b*. Thus, plug 5 is removed as indicated by arrow A in FIG. 1*a*. Plug 5' is removed from opening 4' in a similar manner. Erosion-damaged discharge opening 3 is sealingly closed by a stopper plug of refractory material, which may be the same plug 5 removed from opening 4, or another plug. This is illustrated in FIG. 1*b* by arrow E. Erosion-damaged opening 3' of plate 1' similarly is sealingly closed by a stopper plug of refractory material, for example plug 5'. The plates then are reversed as shown in FIG. 2*b*, with planar surfaces 10, 10' in abutting sliding contact and with erosion-damaged surfaces 8, 8' directed away from each other. Other openings 4, 4', undamaged to this point, then are employed for further discharging of molten metal.

It will be apparent from the above that in accordance with the present invention, one or both of the closure plates of a sliding closure unit may be constructed in a manner to prolong the useful life of the plate or plates. This is achieved in a simple manner without interfering with the normal operation of the unit. Those skilled in the art readily will understand what known materials may be employed for the various element of the present invention.

Furthermore, the present invention has been described and illustrated with respect to a linear movable sliding closure unit. However, the concept of the present invention equally is applicable to rotary movable sliding closure units, whereby one or both of the plates may be provided with plural, circumferentially spaced additional discharge openings closed by stopper plugs of refractory material.

Further, other changes and modifications to the specifically described and illustrated arrangements, as will be apparent to those skilled in the art, may be made without departing from the scope of the present invention.

I claim:

1. In a refractory plate for use as a stationary and/or as a movable closure plate in a sliding closure unit for controlling the discharge of molten metal from a metallurgical vessel wherein the movable refractory plate has therethrough a discharge opening and is slidable with respect to the stationary refractory plate having therethrough a discharge opening between an open position with the discharge openings in alignment and a closed position whereat a surface of the movable plate blocks the discharge opening of the stationary plate, the improvement wherein said refractory plate comprises:

a refractory plate body having parallel opposite entirely planar surfaces including one said surface adapted to slidingly contact the other plate and another surface spaced therefrom;

said discharge opening extending through said body between said opposite planar surfaces;

at least one other discharge opening extending through said body between said opposite planar surfaces;

a stopper plug of refractory material sealingly closing said other discharge opening, said plug having a uniform shape throughout the length thereof in a direction axially of said other discharge opening;

whereby upon use of the unit with resultant erosion damage to said one surface around the first-mentioned said discharge opening of said refractory plate, said refractory plate may be reversed with said another surface adapted to slidingly contact the other plate, with said one surface spaced therefrom, with said plug removed from said other discharge opening, and with a stopper plug of refractory material sealingly closing said first-mentioned discharge opening; and said first-mentioned discharge opening and said other discharge opening being spaced from each other at respective locations such that, when said other discharge opening is plugged and the movable plate is moved toward the closed position of the sliding closure unit, said plug in said other discharge opening is located in an area of said one surface adapted to block the discharge opening of the other plate and such that, when said first-mentioned discharge opening is plugged and the movable plate is moved toward the closed position of the sliding closure unit, said plug in said first-mentioned discharge opening is located in an area of said another surface adapted to block the discharge opening of the other plate.

2. A plate as claimed in claim 1, whereby said body and said plug are formed of identical refractory materials.

3. A plate as claimed in claim 1, wherein said plug comprises a drill core resulting from core drill formation of one of said discharge openings.

4. A plate as claimed in claim 1, wherein said discharge openings therein have the same dimensions.

5. A plate as claimed in claim 1, wherein said plug is fixed in said other discharge opening by means of ceramic setting mortar.

6. A plate as claimed in claim 1, for use in a linear sliding closure unit, wherein said other discharge opening opens onto said one surface adapted to be in abutting sliding contact with a surface of the other plate of the unit, at said area thereof such that said plug is positioned to cover a discharge opening of the other plate upon closing of the unit.

7. A plate as claimed in claim 6, wherein said plug is flush with said one surface.

8. In a sliding closure unit for controlling the discharge of molten metal from a metallurgical vessel including a stationary refractory plate having therethrough a discharge opening, and a movable refractory plate having therethrough a discharge opening, said plates being mounted with mutual surfaces thereof in abutting sliding contact, and said movable plate being slidable with respect to said stationary plate between an open position with said discharge openings in alignment for discharging therethrough molten metal and a closed position with said surface of each said plate blocking said discharge opening of the other said plate, the improvement wherein at least one said plate comprises:

a refractory plate body having parallel opposite entirely planar surfaces including one said surface in sliding contact with the other said plate and another surface spaced therefrom, with the first-mentioned said discharge opening of said one plate extending through said body between said parallel surfaces;

at least one other discharge opening extending through said body between said parallel surfaces;

a stopper plug of refractory material sealingly closing said other discharge opening, said plug having a uniform shape throughout the length thereof in a direction axially of said other discharge opening;

whereby upon use of said unit with resultant erosion damage to said one surface around said first-mentioned discharge opening, said one plate may be reversed with said another surface in sliding with said other plate, with said one surface spaced therefrom, with said plug removed from said other discharge opening, and with a stopper plug of refractory material sealingly closing said first-mentioned discharge opening;

said first-mentioned discharge opening and said other discharge opening being spaced from each other at respective locations such that, when said other discharge opening is plugged and said movable plate is moved toward said closed position thereof, said plug in said other discharge opening is located in an area of said one surface operating to block said discharge opening of said other plate and such that, when said first-mentioned discharge opening is plugged and said movable plate is moved toward said closed position thereof, said plug in said first-mentioned opening is located in an area of said another surface operating to block said discharge opening of said other plate.

9. The improvement claimed in claim 8, wherein said body and said plug are formed of identical refractory materials.

10. The improvement claimed in claim 8, wherein said plug comprises a drill core resulting from core drill formation of one of said discharge openings.

11. The improvement claimed in claim 8, wherein said first-mentioned and other discharge openings have the same dimensions.

12. The improvement claimed in claim 8, wherein said plug is fixed in said other discharge opening by means of ceramic setting mortar.

13. The improvement claimed in claim 8, wherein said unit comprises a linear sliding closure unit, and said other discharge opening opens onto said one surface at said working area thereof such that said plug covers said discharge opening in said other plate upon movement of said movable plate to said closed position thereof.

14. The improvement claimed in claim 13, wherein said plug is flush with said one surface.

15. The improvement claimed in claim 8, wherein each of said movable and stationary plates has therethrough at least one said other discharge opening sealingly closed by a respective said plug, whereby both said plates are reversibly mounted.

16. In a method of discharging molten metal from a metallurgical vessel by means of a sliding closure unit of the type including a stationary refractory plate having therethrough a discharge opening, and a movable refractory plate having therethrough a discharge opening, said plates being mounted with mutual planar surfaces thereof in abutting sliding contact, by sliding said movable plate with respect to said stationary plate between an open position with said discharge openings in alignment, thereby discharging molten metal, and a closed portion with said surface of each said plate blocking said discharge opening of the other said plate, thus interrupting discharge of molten metal, during which operation the molten metal causes erosion damage to said abutting surfaces around said discharge openings, the improvement comprising increasing the useful life of at least one said plate by:

constructing said one plate as a refractory plate body having parallel opposite planar surfaces including one said surface in sliding contact with the other said plate and another surface spaced therefrom, with the first-mentioned said discharge opening of said one plate extending through said body between said parallel surfaces, and with at least one other discharge opening extending through said body between said parallel surfaces;

sealingly closing said other discharge opening with a stopper plug of refractory material, and operating said unit with said one surface in sliding contact with the other said plate until the occurrence of said erosion damage;

removing said plug from said other discharge opening;

sealingly closing said erosion-damaged discharge opening with a stopper plug of refractory material;

reversing said one plate with said another surface thereof in sliding contact with said other plate and with the erosion-damaged said one surface spaced therefrom; and providing said first-mentioned discharge opening and said other discharge opening at respective locations spaced from each other such that, when said other discharge opening is plugged and said movable plate is moved toward said closed position thereof, said plug in said other discharge opening is located in an area of said one surface operating to block said discharge opening of said other plate and such that, when said first-mentioned discharge opening is plugged and said movable plate is moved toward said closed position thereof, said plug in said first-mentioned opening is located in an area of said another surface operating to block said discharge opening of said other plate.

17. The improvement claimed in claim 16, comprising closing said erosion-damaged discharge opening by means of said plug removed from said other discharge opening.

18. The improvement claimed in claim 16, comprising fixing said plugs in respective said discharge openings by means of ceramic setting mortar.

19. The improvement claimed in claim 16, comprising constructing each of said movable and stationary plates to have therethrough at least one said other discharge opening closed by a respective said plug, and, after said erosion damage to both said plates, removing said plugs from both said other discharge openings, closing both said erosion-damaged discharge openings with respective said plugs, and reversing both said plates.

20. The improvement claimed in claim 16, comprising providing said first-mentioned and other discharge openings at said respective locations such that said plugs cover said discharge opening in said other plate when said movable plate is in said closed position.

* * * * *